US010294006B2

(12) United States Patent
Wu

(10) Patent No.: US 10,294,006 B2
(45) Date of Patent: May 21, 2019

(54) CONTAINER FOR ACCOMMODATING MULTIPLE MATERIALS IN ISOLATED MANNER

(71) Applicant: Kuo-Cheng Wu, Kaohsiung (TW)

(72) Inventor: Kuo-Cheng Wu, Kaohsiung (TW)

( * ) Notice: Subject to any disclaimer, the term of this patent is extended or adjusted under 35 U.S.C. 154(b) by 0 days.

(21) Appl. No.: 15/696,316

(22) Filed: Sep. 6, 2017

(65) Prior Publication Data

US 2019/0071236 A1 Mar. 7, 2019

(51) Int. Cl.
*B65D 25/04* (2006.01)
*B65D 41/02* (2006.01)
*B65D 81/32* (2006.01)

(52) U.S. Cl.
CPC ..... *B65D 81/32* (2013.01); *B65D 25/04* (2013.01); *B65D 41/02* (2013.01)

(58) Field of Classification Search
CPC .... B65D 81/32; B65D 81/3266; B65D 25/04; B65D 41/02
USPC ..... 206/219–221; 220/503
See application file for complete search history.

(56) References Cited

U.S. PATENT DOCUMENTS 2,016,488 A * 10/1935 Eckhaus ..... B65D 17/00 220/274
2,275,567 A * 3/1942 Smith ..... B65D 51/2871 200/19.06
2,494,294 A * 1/1950 Greenberg ..... A61J 1/2093 206/221
2,611,499 A * 9/1952 Mayer ..... B65D 1/10 215/6
2,689,566 A * 9/1954 Lockhart ..... B65D 25/085 206/221
2,773,591 A * 12/1956 Jensen ..... B65D 25/08 206/220
3,321,097 A * 5/1967 Solowey ..... B65D 1/04 206/221
5,634,714 A * 6/1997 Guild ..... A61J 1/2093 206/220
2013/0306498 A1* 11/2013 Azani ..... B65D 1/04 206/219

(Continued)

FOREIGN PATENT DOCUMENTS

TW I271358 1/2007

*Primary Examiner* — Chun Hoi Cheung
(74) *Attorney, Agent, or Firm* — Rosenberg, Klein & Lee

(57) ABSTRACT

A container includes a body, a main cap, and an operating set movably inserted into the body. The body has two communicating accommodation areas, a top opening communicating with one of the accommodation areas and covered by the main cap, a partition dividing the other accommodation area into accommodation spaces, and an enclosing wall laterally disposed between the accommodation areas and defining an enclosing opening. The operating set includes a shank, two ends of which respectively formed a head protruding from the main cap and an engagement unit having at least one trough which faces the partition through the enclosing opening. When the engagement unit moves to the partition, the partition is lodged into the trough for placing the engagement unit in position. Therefore, the enclosing opening is sealed to prevent the accommodation areas and the accommodation spaces from communicating with each other and attain a preferable sealing effect.

5 Claims, 5 Drawing Sheets

(56) References Cited

U.S. PATENT DOCUMENTS

| | | | | |
|---|---|---|---|---|
| 2014/0001064 | A1* | 1/2014 | Aloia | B65D 81/3211 206/221 |
| 2015/0101942 | A1* | 4/2015 | Wu | B65D 81/3211 206/219 |

* cited by examiner

CONTAINER FOR ACCOMMODATING MULTIPLE MATERIALS IN ISOLATED MANNER

BACKGROUND OF THE INVENTION

1. Field of the Invention

This invention relates to a container and relates particularly to a container capable of accommodating and separating multiple materials effectively to achieve a preferable sealing effect.

2. Description of the Related Art

Generally, a conventional container has only one accommodation room for receiving one kind of materials. If additional materials are required, all of the materials should be mixed in advance of filling into the container. For instance, sufficient treacle or ingredients should be mixed with a beverage before filling into the container for selling. Further, ingredients of alcoholic beverages, such as fruit cocktail, should also be well-mixed before filling into the container. However, the beforehand mixing operation may advance the expiration of the materials or result in deterioration. In order to prevent the mixed materials from deteriorating, the user has to separate different materials in different containers and mix all of the materials in another container while drinking that results in great inconvenience.

Referring to FIG. 1, a Taiwan Patent No. I271358 disclosing an outlet cover 1 of a container comprises a bottle 11, a cap 12 connected to the bottle 11, and a block unit 13 capable of engaging with the cap 12. The bottle 11 has a mouth 111 disposed on one side of the bottle 11, a connecting portion 112 disposed around an exterior peripheral wall of the bottle 11 and adjacent to the mouth 111, and an accommodation room 113 extending downwards from the mouth 111 and filled with a first material A. The cap 12 has a top surface 121, a side surface 122 extending from the top surface 121 to define a hollow space 123 in the cap 12, an opening 124 formed on the cap 12 and opposite to the top surface 121 to allow the hollow space 123 to communicate with the outside, and a communication channel 125 formed around an interior peripheral wall of the side surface 122 and adjacent to the opening 124. The block unit 13 is disposed between the hollow space 123 and the communication channel 125 when the cap 12 covers on the bottle 11. Hence, the user can fill the hollow space 123 with a second material B and mount the block unit 13 in the cap 12 to seal the hollow space 123. When the communication channel 125 of the cap 12 engages with connection portion 112 of the bottle 11, the block unit 13 separates the hollow space 123 and the accommodation room 111 to prevent the first material A from mixing with the second materials B. Referring to FIG. 2, the use mixes the first and the second material A'B by rotating the cap 12 downwards to allow the mouth 111 and the connecting portion 112 to push the block unit 13.

When the block unit 13 stops engaging with the cap 12, the hollow space 123 communicates with the accommodation room 113 to allow the second material B within the cap 12 to mix with the first material A in the bottle 11. Whereby the mixing action of the first and the second material A'B is achieved.

However, the cap 12 is disposed on the bottle 11 in advance of selling and a rotation margin is maintained between the cap 12 and the bottle 11 to allow the user to mix the first and the second material A'B by rotating the cap 12.

Therefore, the second material B within the cap 12 may mix with the first material A within the bottle 11 accidentally by improper pressing of other force caused during the transportation or caused by people who do it with curiosity. Hence, customer may refuse to buy the container which is filled with mixed materials. Moreover, the cap 12 has only one hollow space 123 for accommodating one kind of materials and the bottle 11 also has only one accommodation room 113 for accommodating one kind of materials. In other words, the container can be only applied to mix two kinds of materials. Thus, the adaptability of the container is poor if a mixture including more than two kinds of materials is preferred.

Therefore, the object which those people skilled in the art aims to reach is to invent a convenient container structure which can not only receive multiple materials but attain a good sealing effect. Hence, the container 3 as claimed in this invention is directed to an improved container which accommodates different kinds of materials and attains a preferable sealing effect.

SUMMARY OF THE INVENTION

The object of this invention is to provide a container capable of accommodating multiple materials simultaneously while ensuring a preferable sealing effect to achieve a better preserving effect.

The container of this invention includes a body, a main cap connected to the body, and an operating set movably penetrating into the body. The body has a first accommodation area and a second accommodation area formed in the body respectively, a top opening communicating with the second accommodation area and covered by the main cap, at least one partition fitted in the first accommodation area and defining a plurality of accommodation spaces, and an enclosing wall laterally fitted between the first and the second accommodation area and defining an enclosing opening. The main cap has a bottom surface capable of engaging with the first end for covering the top opening, a plurality of positioning units protruding from the bottom surface, and a positioning recess enclosed by the positioning units. The operating set has a shank, an engagement unit fitted at one end of the shank and capable of engaging with the partition, and a head fitted at another end of the shank and penetrating from the main cap. At least one trough formed on a surface of the engagement unit and facing the partition. Hence, when the accommodation spaces are filled with materials respectively, the main cap covers on the body to allow the engagement unit to reach the partition. The partition embeds into the trough to position the engagement unit which is enclosed by enclosing wall. Then, the second accommodation area is ready for filling with another material. Thus, the enclosing opening is sealed to prevent the first and the second accommodation area and the accommodation spaces from communicating with each other and attain the preferable sealing effect.

Preferably, the body has a bottom opening enclosed by the second end of the body and sealed by a bottom cap.

Preferably, a sealing membrane is fitted between the partition and the bottom cap.

Preferably, a neck portion is formed on the shank and abutting upon the engagement unit.

Preferably, the container further includes an auxiliary cap which has a peripheral wall for engaging with the main cap to cover the main cap. The head is covered by the auxiliary cap when the auxiliary cap is fitted on the main cap.

DETAILED DESCRIPTION OF THE PREFERRED EMBODIMENTS

Figure 2:
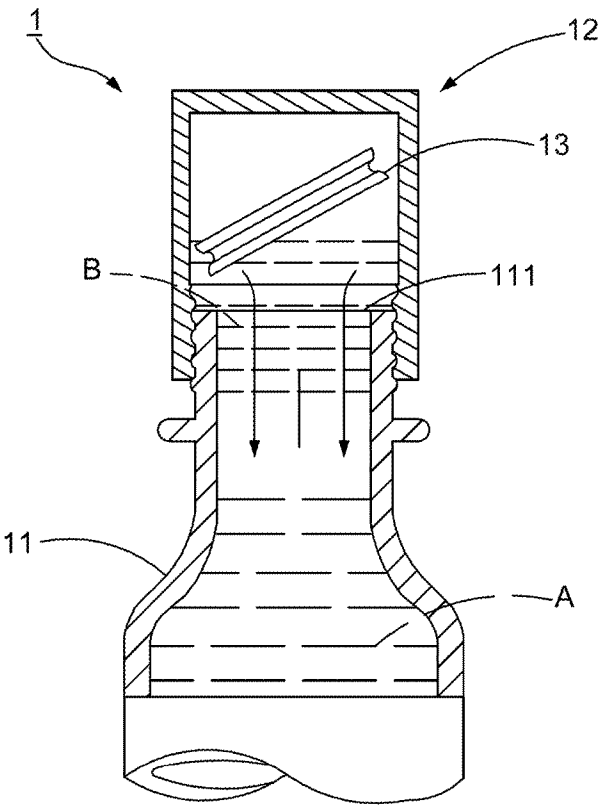
FIG. 2 (Prior Art)
FIG. 2 is a schematic view showing how the conventional container operates.
Figure 1:
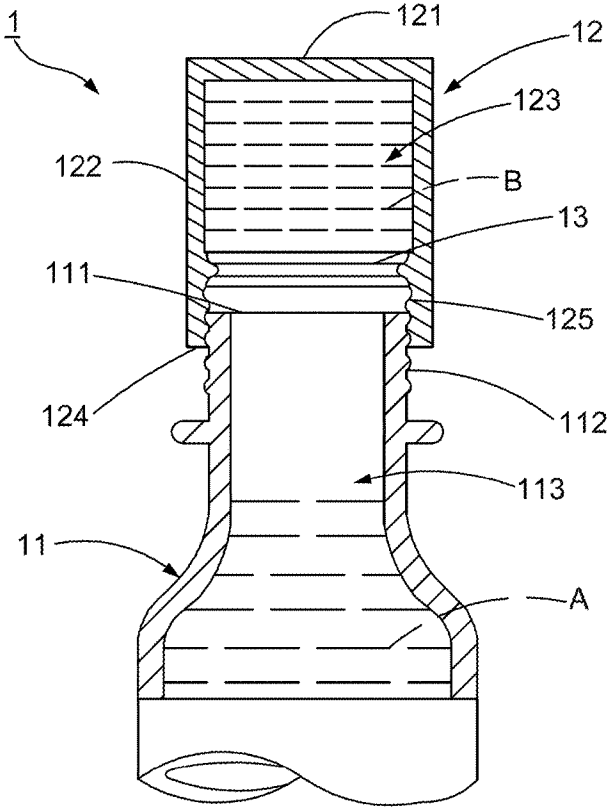
FIG. 1 (Prior Art)
FIG. 1 is a schematic view showing a conventional container.
Figure 3:
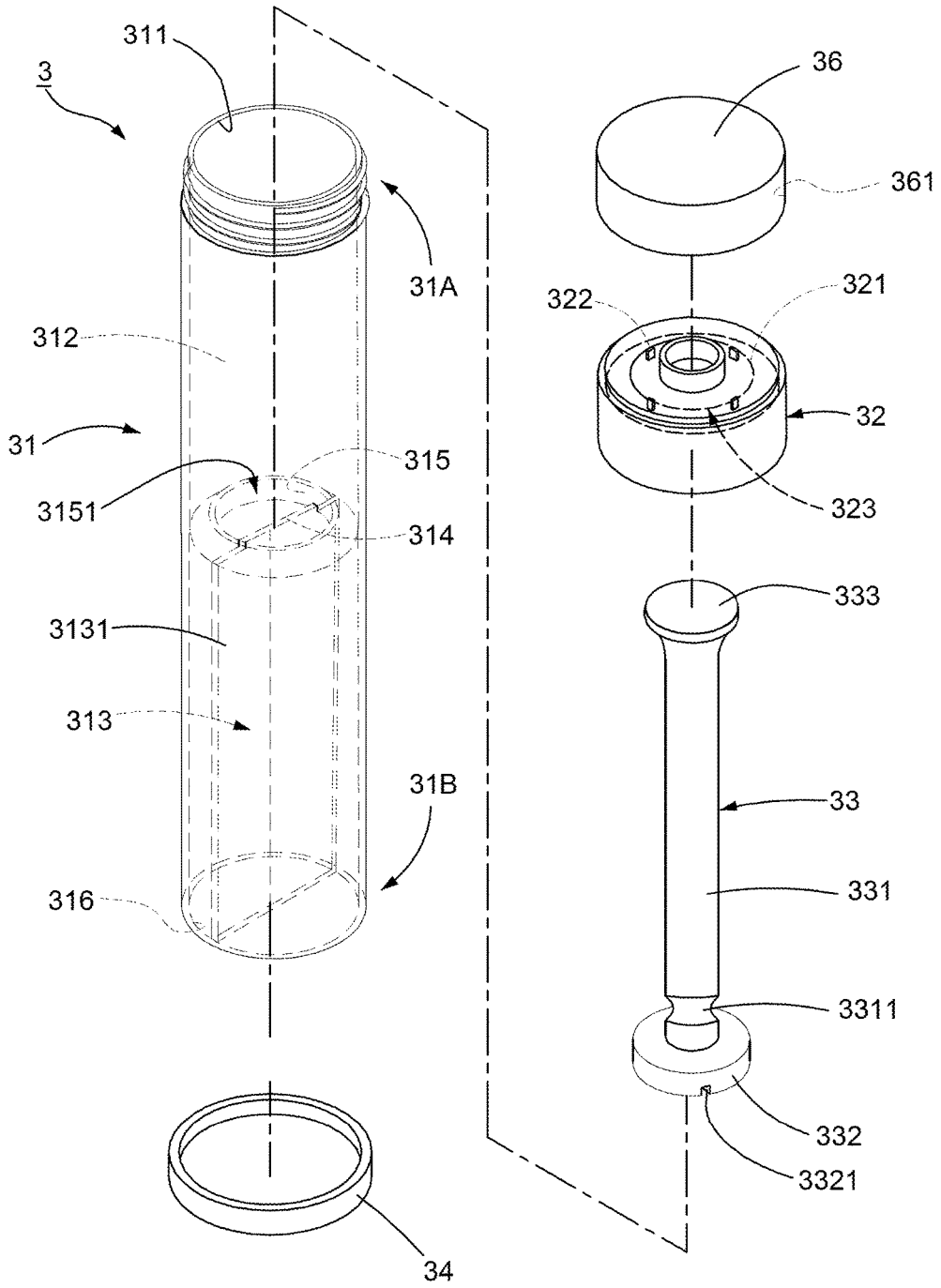
FIG. 3 is an exploded view showing a first preferred embodiment of this invention.
Figure 4:
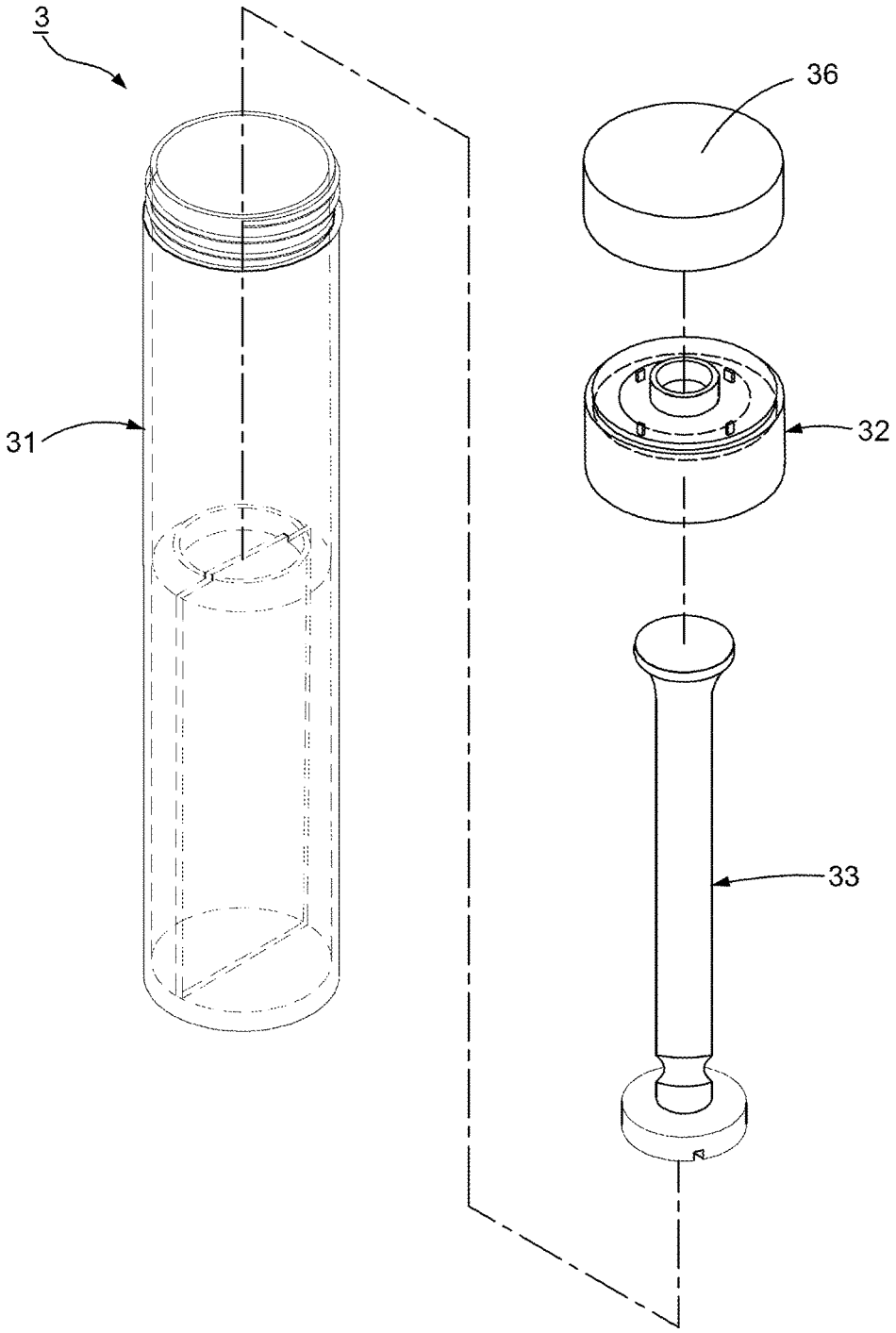
FIG. 4 is an exploded view showing a second preferred embodiment of this invention.

Referring to FIG. 3, a first preferred embodiment of a container 3 of this invention includes a body 31 defined a first end 31A and a second end 31B, a main cap 32 formed separately and connected to the body 31, and an operating set 33 threading through the main cap 32 and movably introducing into the body 31. The body 31 has a top opening 311 formed on the first end 31A and covered by the main cap 32, a second accommodation area 312 extending downwards from the top opening 311, a first accommodation area 313 formed between the second accommodation area 312 and the second end 31B, at least one partition 314 fitted in the first accommodation area 313 and diving the first accommodation area 313 into a plurality of independent accommodation spaces 3131, and an enclosing wall 315 laterally fitted between the first accommodation area 313 and the second accommodation area 312. The enclosing wall 315 encloses an enclosing opening 3151 which allows the accommodation spaces 3131 to communicate with the second accommodation area 312. The amount of the accommodation spaces 3131 can be adjusted by increasing or decreasing the amount of the partition 314 according to needs. Here takes an example that two partition 314 are applied to divide the first accommodation area 313 into two accommodation spaces 3131. Further, the second end 31B of the body 31 can be formed with a bottom opening 316 as shown in FIG. 3. The bottom opening 316 is covered by a bottom cap 34. Or, the second end 31B of the body 31 can be formed in an enclosed type as shown in FIG. 4. The bottom cap 34 is not required if the enclosed type is applied. In this preferred embodiment, it is taken as an example that the body 31 has the bottom opening 316 enclosing by the second end 31B and sealed by the bottom cap 34.

The main cap 32 has a bottom surface 321 capable of engaging with said first end 31A for covering the top opening 311, a plurality of positioning units 322 projecting from the bottom surface 321, and a positioning recess 323 enclosed by the positioning units 322. The positioning units 322 project from the bottom surface 321 toward a direction of the second end 31B of the body 31 when the main cap 32 covers on the body 31. The operating set 33 has a shank 331 movably projecting into the second accommodation area 312, an engagement unit 332 connected to one end of the shank 331 and capable of engaging with the partition 314, and a head 333 connected to another end of the shank 331 and projecting from the main cap 32. The engagement unit 332 has at least one trough 3321 recessing into a surface of the engagement unit 332 in a position facing the partition 314 through the enclosing opening 3151. Thus, the partition 314 is inlayed in the trough 3321 of the engagement unit 332 when the engagement unit 332 engages with the partition 314 to seal the enclosing opening 3151. Meanwhile, the engagement unit 332 is positioned and enclosed by the enclosing wall 315. Hence, the enclosing opening 3151 is sealed completely to prevent the first accommodation area 313 from communicating with the second accommodation area 312. When the head 333 and the shank 331 are pulled toward a direction of the first end 31A of the body 31, the engagement unit 332 moves upwards simultaneously and engages with the positioning units 322 to be situated at the positioning recess 323. In this preferred embodiment, the shank 331 is formed with a neck portion 3311 which is located near the engagement unit 332. Further, the container 3 includes an auxiliary cap 36 having a peripheral wall 361 for engaging with the main cap 32. The head 333 is covered by the auxiliary cap 36 when the auxiliary cap 36 is fitted on the main cap 32.

Referring to FIG. 3 and FIG. 5, in use of the container 3, the user fills one accommodation space 3131 with a first material A and fills another accommodation space 3131 with a second material B. After the accommodation spaces 3131 are filled with the first materials A and the second materials B respectively, the user holds the head 333 to insert the shank 331 and the engagement unit 332 into the second accommodation area 312 through the top opening 311. When the engagement unit 332 moves to the partition 314, the trough 3321 engages with the partition 314. In other words, the partition 314 embeds itself into the trough 3321. Hence, the enclosing opening 3151 is sealed fully to prevent the second accommodation area 312 from communicating with the accommodation spaces 3131 effectively. Meanwhile, the engagement unit 332 is enclosed by the enclosing wall 315 while engaging with the partition 314. Whereby the second accommodation area 312 and the accommodation spaces 3131 are separated entirely to achieve a preferable sealing effect.

Figures 5A, 5B, 5C:
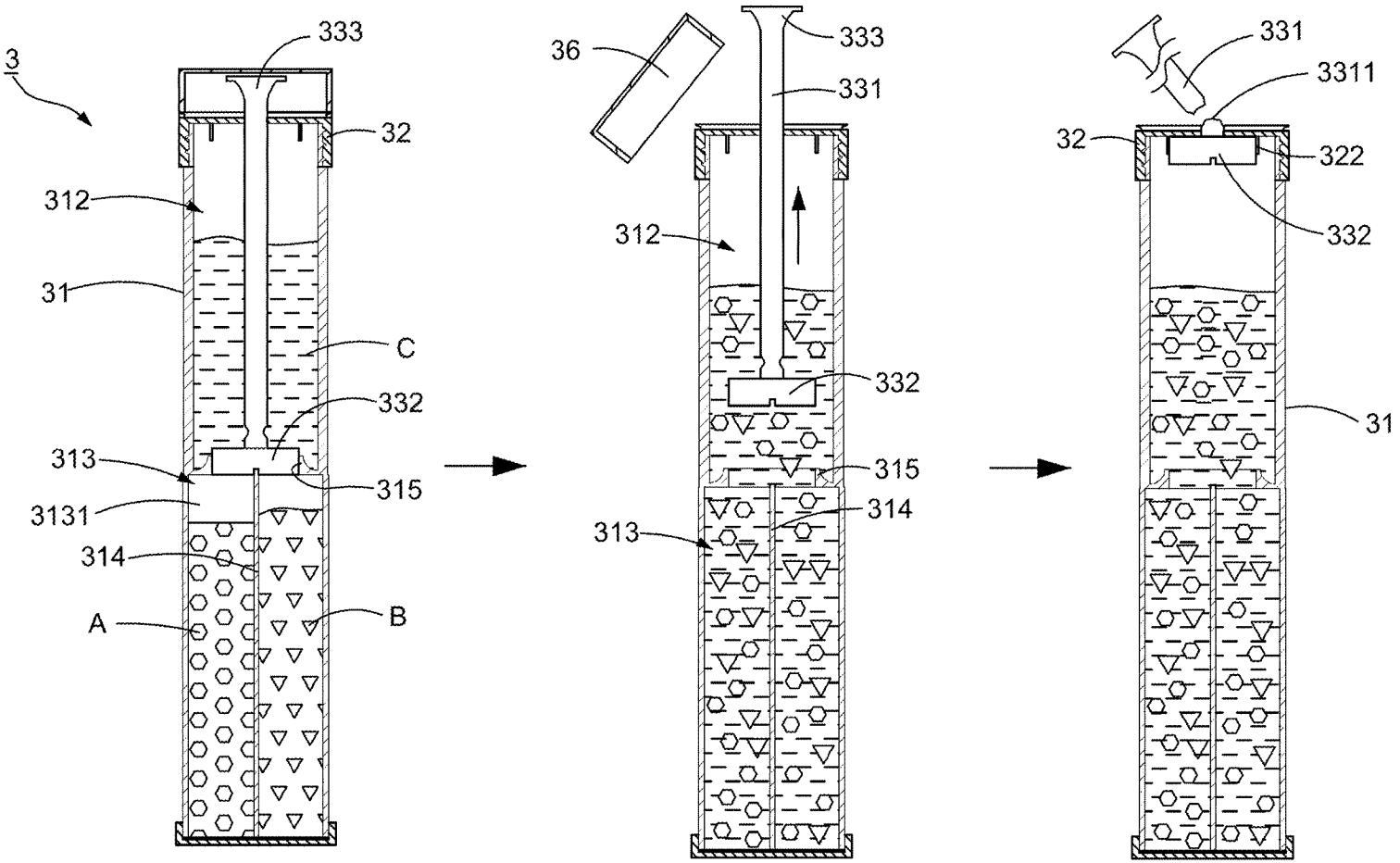
FIG. 5A is a schematic view showing that the container is completed with filling materials.
FIG. 5B is a schematic view showing that the auxiliary cap is removed and the operating set is separated from the enclosing opening.
FIG. 5C is a schematic view showing that the shank is snapped and the materials are well-mixed.

After the engagement unit 332 seals the enclosing opening 3151, the user fills the second accommodation area 312 with a third material C through the top opening 311 and engages the main cap 32 with the first end 31A by rotating the main cap 32 to seal the top opening 311 and complete the beforehand filling operation of the materials. Hence, the enclosing opening 3151 is sealed effectively to separate the first, the second and the third material A'B'C by the engagement of the partition 314 and the engagement unit 332. Moreover, the user engages the peripheral wall 361 of the auxiliary cap 36 with the main cap 32 to situate the head 333 within the auxiliary cap 36 as shown in FIG. 5A. Therefore, the head 333 will not be pulled by accident, thereby preventing all of the materials A-BC from being mixed together before selling.

Before drinking, the user removes the auxiliary cap 36 and pulls the head 333 toward a direction opposite to the partition 314 to allow the shank 331 and the engagement unit 332 to move upwards simultaneously, as shown in FIG. 5B. The engagement unit 332 then separates from the partition 314 and the enclosing wall 315 to allow the accommodation spaces 3131 to communicate with the second accommodation area 312. Referring to FIG. 5C, the engagement unit 332 further engages with the positioning units 322 in the positioning recess 323 when the engagement unit 332 moves upwards to the main cap 32. Hence, the first, the second and the third material A'B'C are mixed together because the enclosing opening 3151 is no longer sealed to allow the accommodation spaces 3131 to communicate with the second area 312. Whereby the mixing operation of the materials ABC is completed. Furthermore, after the engagement unit 332 engages with the positioning units 322, the user can snap the shank 331 easily by bending the neck portion 3311 to remove the unnecessary part of the shank 331. Therefore, the unnecessary part of the shank 331 will not trouble the user while the user mixes all of the materials A'B'C by shaking the container 3. Meanwhile, the materials A'B'C will not leak from the container 3 because the engagement unit 332 engages with the positioning units 322 to seal the main cap 32 through which the shank 331 projects. Whereby the use convenience is increased. Finally, the user enjoys the well-mixed materials by separating the main cap 32 from the first end 31A of the body 31 and drinks the well-mixed materials through the top opening 311 directly or by pouring the well-mixed materials into a cup for drinking. Whereby the container 3 can separate different kinds of materials effectively and mix all of the materials quickly to attain the preferable sealing effect, increase the adaptability and enhance the use convenience.

Figure 6:
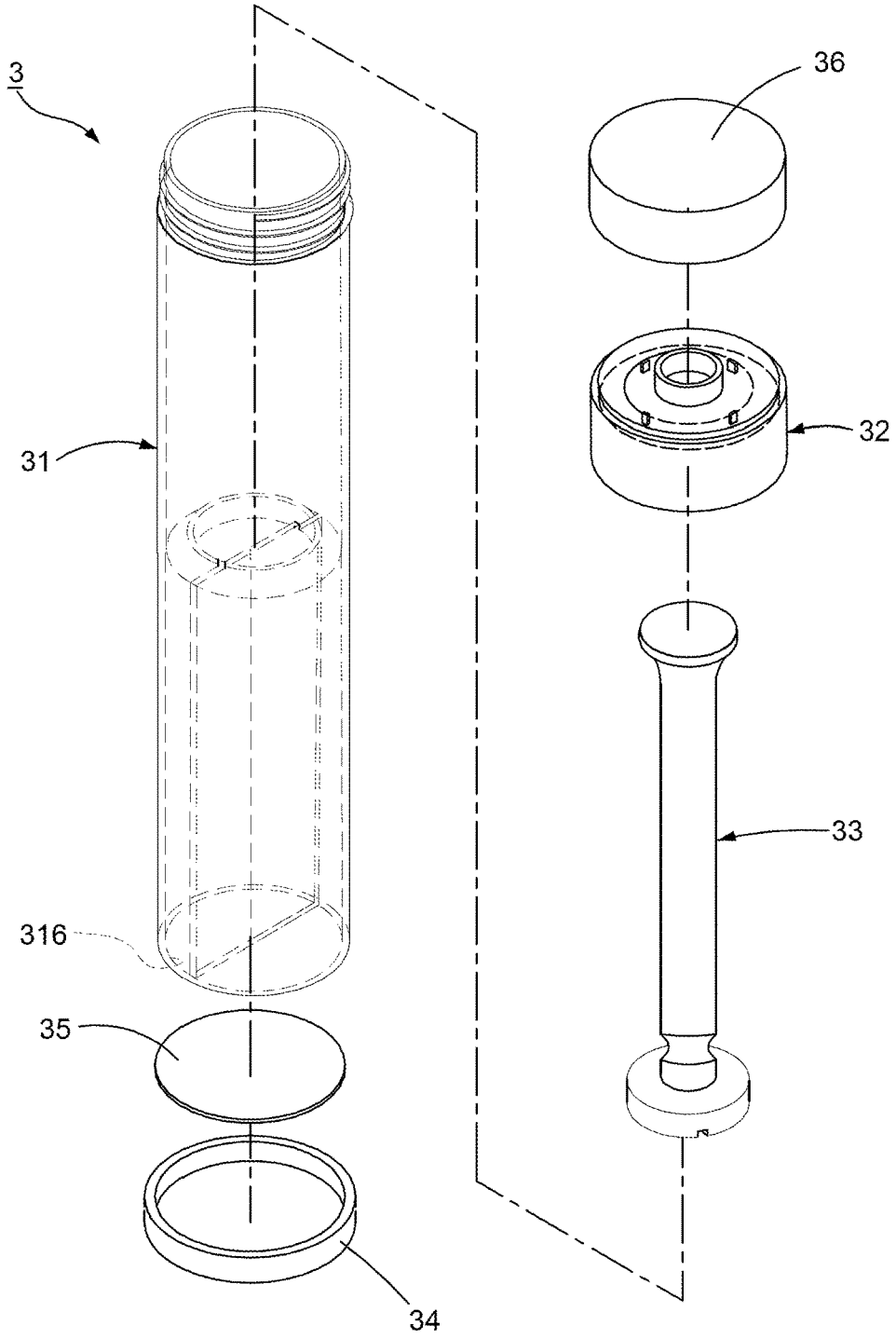
FIG. 6 is an exploded view showing a third preferred embodiment of this invention.

Referring to FIG. 6 shows a third preferred embodiment of the container 3 of this invention. The correlated elements, the concatenation of elements, the operation and objectives of the third preferred embodiment are the same as those of the first preferred embodiment. This embodiment is characterized in that a sealing membrane 35 is disposed between the partition 314 and the bottom cap 34. Although the bottom opening 316 can be sealed by the engagement of the bottom cap 34 and the second end 31B of the body 31, the sealing membrane 35 can enhance the sealing effect between the bottom cap 34 and the partition 314 to prevent the materials within the body 31 from leaking. Whereby the preferable sealing effect is achieved.

To sum up, the container of this invention takes advantages that at least one partition divides the first accommodation area into the accommodation spaces, the engagement unit engages with the partition through the trough to seal the enclosing opening effectively, and the enclosing wall encloses the engagement unit to prevent the first and the second accommodation area and the accommodation spaces from communicating with each other and attain the preferable sealing effect.

While the embodiments of this invention are shown and described, it is understood that further variations and modifications may be made without departing from the scope of this invention.

What is claimed is:

1. A container comprising:

a body with a first end and a second end;

a main cap connected to said body; and an operating set penetrating through a through hole of said main cap and movably inserted into said body;

wherein said body includes a top opening formed at said first end covered by said main cap, a second accommodation area extending downwards from said top opening, a first accommodation area formed between said second accommodation area and said second end, at least one partition disposed in said first accommodation area to define a plurality of independent accommodation spaces, and an enclosing wall laterally disposed between said first accommodation area and said second accommodation area and defining an enclosing opening, said plurality of accommodation spaces communicating with said second accommodation area through said enclosing opening;

wherein said main cap includes a bottom surface engaging with said first end for covering said top opening, a plurality of positioning units protruding from said bottom surface, the positioning units being spaced from one another and disposed along a positioning recess; and wherein said operating set includes a shank movably inserted in said second accommodation area, an engagement unit connected to one end of said shank for releasably engaging said at least one partition, and a head connected to another end of said shank and protruding from said main cap, at least one trough being formed on a surface of said engagement unit in a position facing said at least one partition through said enclosing opening, said at least one partition engaging said at least one trough of said engagement unit when said engagement unit releasably engages an upper edge of said at least one partition to seal said enclosing opening and prevent said first accommodation area from communicating with said second accommodation area, said engagement unit being retentively engaged with said plurality of positioning units in said positioning recess when said engagement unit moves upwards to said top opening to thereby seal said through hole of said main cap.

2. The container as claimed in claim 1, wherein said body includes a bottom opening enclosed by said second end of said body and sealed by a bottom cap.

3. The container as claimed in claim 2, wherein a sealing membrane is disposed between said at least one partition and said bottom cap.

4. The container as claimed in claim 1, wherein a neck portion is formed on said shank adjacent to said engagement unit.

5. The container as claimed in claim 1 further comprising an auxiliary cap having a peripheral wall in engagement with said main cap for covering said main cap, said head being covered by said auxiliary cap when said auxiliary cap is disposed on said main cap.

* * * * *